United States Patent [19]

Hustad et al.

[11] Patent Number: 4,577,757

[45] Date of Patent: Mar. 25, 1986

[54] GROOVED BASE PACKAGE

[75] Inventors: Gerald O. Hustad, McFarland; Ray H. Griesbach, Monona; James Anderson, Madison, all of Wis.

[73] Assignee: Oscar Mayer Foods Corporation, Madison, Wis.

[21] Appl. No.: 642,470

[22] Filed: Aug. 20, 1984

[51] Int. Cl.[4] ..... B65D 6/02

[52] U.S. Cl. ..... 206/461; 206/499; 220/352; 229/2.5 R; 426/106; 426/129

[58] Field of Search ..... 206/461, 467, 469, 525, 206/526, 499, 470, 462, 466, 468, 471; 229/2.5 R, 93; 220/352; 426/106, 129

[56] References Cited

U.S. PATENT DOCUMENTS

| | | | |
|---|---|---|---|
| 2,814,381 | 11/1957 | Stevick | 426/129 X |
| 3,367,491 | 2/1968 | Dunham et al. | 206/468 |
| 3,498,018 | 3/1970 | Seiferth et al. | 206/525 X |
| 3,580,413 | 5/1971 | Quackerbush | 229/2.5 R |
| 3,685,717 | 8/1972 | Seiferth et al. | 229/2.5 R |
| 4,427,129 | 1/1984 | Wyslotsky et al. | 229/2.5 R X |
| 4,427,705 | 1/1984 | Wyslotsky et al. | 426/106 |
| 4,485,920 | 12/1984 | Skylvik | 206/468 |

FOREIGN PATENT DOCUMENTS

| | | | |
|---|---|---|---|
| 2402599 | 5/1979 | France | 229/2.5 R |
| 813415 | 5/1959 | United Kingdom | 229/2.5 R |
| 864039 | 3/1961 | United Kingdom | 229/2.5 R |

*Primary Examiner*—Allan N. Shoap
*Assistant Examiner*—Bryon Gehman
*Attorney, Agent, or Firm*—Joseph T. Harcarik; Thomas R. Savoie; Daniel J. Donovan

[57] ABSTRACT

A container for sliced meat products or the like has a base including a marginal base flange, a raised pedestal, and a short peripheral sidewall connecting the pedestal to the marginal base flange. A cover is also provided including a marginal cover flange and a cavity, the cavity being formed by a raised top wall and a long peripheral sidewall connecting the marginal cover flange to the top wall. A plurality of concave channels are provided along the interior surface of the long peripheral sidewall. These channels extend from the top wall and terminate at a height above the marginal cover flange which is greater than or equal to the height of the short peripheral sidewall of the base. A plurality of depressions or grooves are also provided in the upper surface of the pedestal. Preferably, the grooves extend substantially perpendicularly to the adjacent portion of the short peripheral sidewall and are equidistantly spaced. In addition, the end of each groove adjacent the short peripheral sidewall is matingly positioned adjacent a corresponding lower end of a respective concave channel.

13 Claims, 5 Drawing Figures

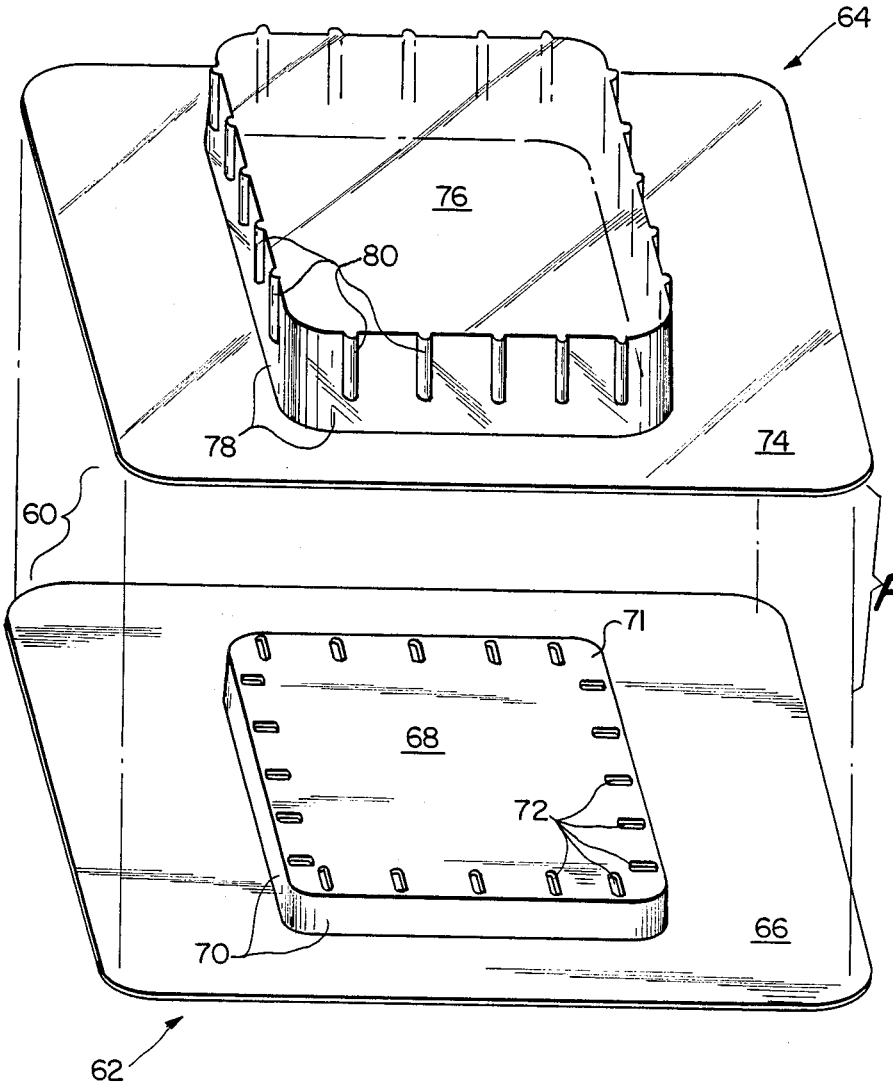
FIG. 4
FIG. 5
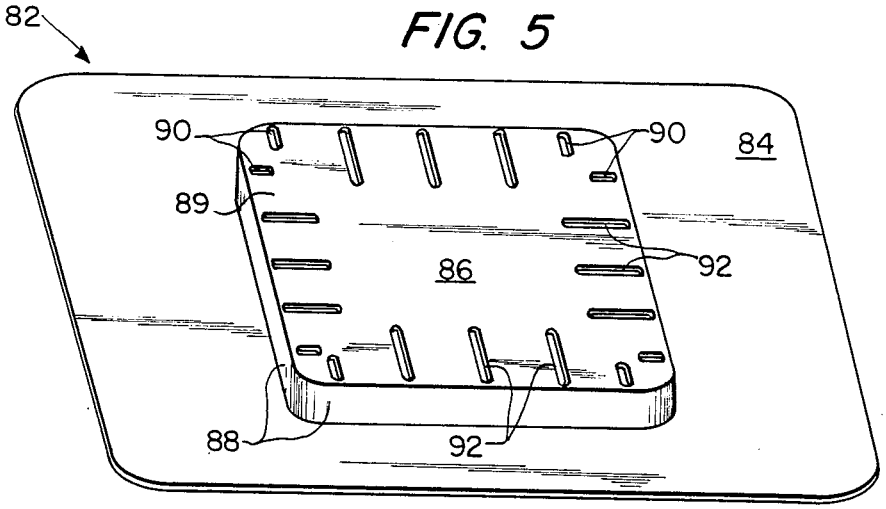

GROOVED BASE PACKAGE

FIELD OF THE INVENTION

The present invention relates generally to innovations and improvements in a semi-rigid package thermoformed from flexible or rigid plastic sheet material for packaging sliced meat products and the like, and more particularly to an improved package of the type having a raised pedestal integrally formed within the margins of a base and a cavity formed within the margins of a cover.

BACKGROUND OF THE INVENTION

A one-compartment semi-rigid transparent package is disclosed in U.S. Pat. No. 3,498,018 (Seiferth et al) and a two-compartment semi-rigid transparent package is disclosed in U.S. Pat. No. 3,685,717 (Seiferth et al). The packages disclosed in these patents are typical of the type having a base provided with a marginal base flange, a peripheral sidewall, and a raised pedestal on which sliced meat products or the like are stacked. Enclosing the meat product is a cover which is adhesively attached to the marginal flange of the base and which has a cavity inside of which the meat product is located. The cavity is formed by a top wall and a peripheral sidewall connecting the top wall to a marginal flange of the cover. The peripheral sidewall is rectangularly or cylindrically shaped and has a plurality of concave channels disposed vertically along the interior surface thereof. These channels extend along the entire length of the peripheral sidewall and are used to add rigidity to the sidewall, to provide a bellows-like action so that larger or smaller charges of product can be snugly engaged, and to aid in evacuation of air past the meat product during sealing of the package. Typically, the base is not transparent, whereas the cover is transparent so that the meat product can be viewed.

Although the packages typical of the type described above have proven highly successful in the packaging art, there are a few drawbacks to this type of package due to the presence of free liquids from the processed meat products, especially non-transparent free liquids or liquids containing particulate matter (e.g. pepper). Thus, even though the concave channels aid in evacuation of the meat product, the presence of free liquids in these channels adjacent the peripheral sidewall of the base sometimes presents a striped appearance, especially if the liquid is colored, around the peripheral sidewall of the pedestal which may be objectional to some consumers. In addition, the free liquids occasionally migrate along the peripheral sidewall and may even extend between the overlaping portions of the base and cover and interfere with the adhesive attachment therebetween.

There has also been disclosed in the prior art various packages which include depressions or cups in the base in which juices are trapped. Typical of these prior art devices are those disclosed in the following U.S. Pat. Nos. 2,974,843 (Reifers et al); 3,040,947 (Wells et al); 2,040,949 (Foote); 3,253,762 (Gaunt); and 3,288,346 (Peppler). U.S. Pat. No. 3,155,303 (Fenkel) also discloses a meat package tray having a corrugated bottom tilting centrally to a well for the collection of juices in the well. The provision of spaced ridges located around the periphery of the portion of a container immediately adjacent the meat so that the depth of the meat below the ridges can be seen by the consumer is disclosed in U.S. Pat. No. 4,278,693 (Dingethal et al).

SUMMARY OF THE INVENTION

The present invention is an improved package for sliced meat products or other food products and the like. The package includes a base which is horizontal in use and having a marginal base flange, a raised pedestal upon which the product is placed, and a short peripheral sidewall extending vertically from the marginal base flange to the pedestal around the periphery of the pedestal. The package further includes a cover which is horizontal in use having a marginal cover flange shaped complementary to the marginal base flange, a raised top wall under which the product is located, and a long peripheral sidewall extending vertically from the marginal base flange to the top wall. The long peripheral sidewall is provided with concave channels along the interior surface extending from the top wall towards the marginal cover flange. However, the concave channels terminate at a height above the marginal cover flange which is greater than the height of the short peripheral sidewall of the base. Thus, when the short peripheral sidewall of the base is snugly received inside the long peripheral sidewall of the cover until the marginal base flange contacts the marginal cover flange, the concave channels terminate above the short peripheral sidewall. The upper surface of the pedestal is further provided with a plurality of depressions or grooves which extend longitudinally away from an adjacent portion of the short peripheral sidewall.

In a preferred embodiment of the present invention, the grooves terminate just prior to the short peripheral sidewall. However, in one embodiment, the grooves extend all the way to the adjacent short sidewall. Preferably, the grooves extend substantially perpendicularly to an adjacent portion of the short peripheral sidewall and are equidistantly spaced along the short sidewall.

In the preferred embodiment, the end of each groove adjacent a respective portion of the short peripheral sidewall is matingly positioned adjacent a corresponding lower end of a respective concave channel in the long peripheral sidewall of the cover. In another embodiment of the invention, a central cavity is also provided in the pedestal with the ends of a plurality of the grooves opening into this cavity. Depending on the meat product or other food product, the pedestal can be circularly shaped with radially directed grooves or rectangularly shaped with grooves directed radially outwardly or perpendicularly to an adjacent portion of the short peripheral sidewall. Where the food product is rectangular, the pedestal is preferably rectangularly shaped and if the grooves are perpendicular to an adjacent portion of the short peripheral sidewall, the grooves adjacent a corner are shorter than the remainder of the grooves.

It is an advantage of the present invention that free liquids and free liquids containing particulate matter from the meat products or the like are collected in the grooves provided. In this manner, migration of the free liquids between the short peripheral sidewall of the base and the long peripheral sidewall of the cover is reduced or eliminated. In addition, migration of the free liquids between the marginal cover flange and marginal base flange is also reduced or eliminated.

It is also a feature of the present invention that the concave channels provided in the long peripheral sidewall of the cover do not extend below the short peripheral sidewall of the base. Therefore, if present in the channels, free liquids, especially if non-transparent and/or containing particulate matter, do not present a striped effect around the short peripheral sidewall of the base.

Other features and advantages of the present invention are stated in or apparent from a detailed description of presently preferred embodiments of the invention found hereinbelow.

BRIEF DESCRIPTION OF THE DRAWINGS

FIG. 4 is an exploded perspective view of an alternative embodiment of a package according to the present invention.

FIG. 5 is a perspective view of an alternative embodiment of a base for use with the cover depicted in FIG. 4.

DETAILED DESCRIPTION OF THE PREFERRED EMBODIMENTS

Figure 1:
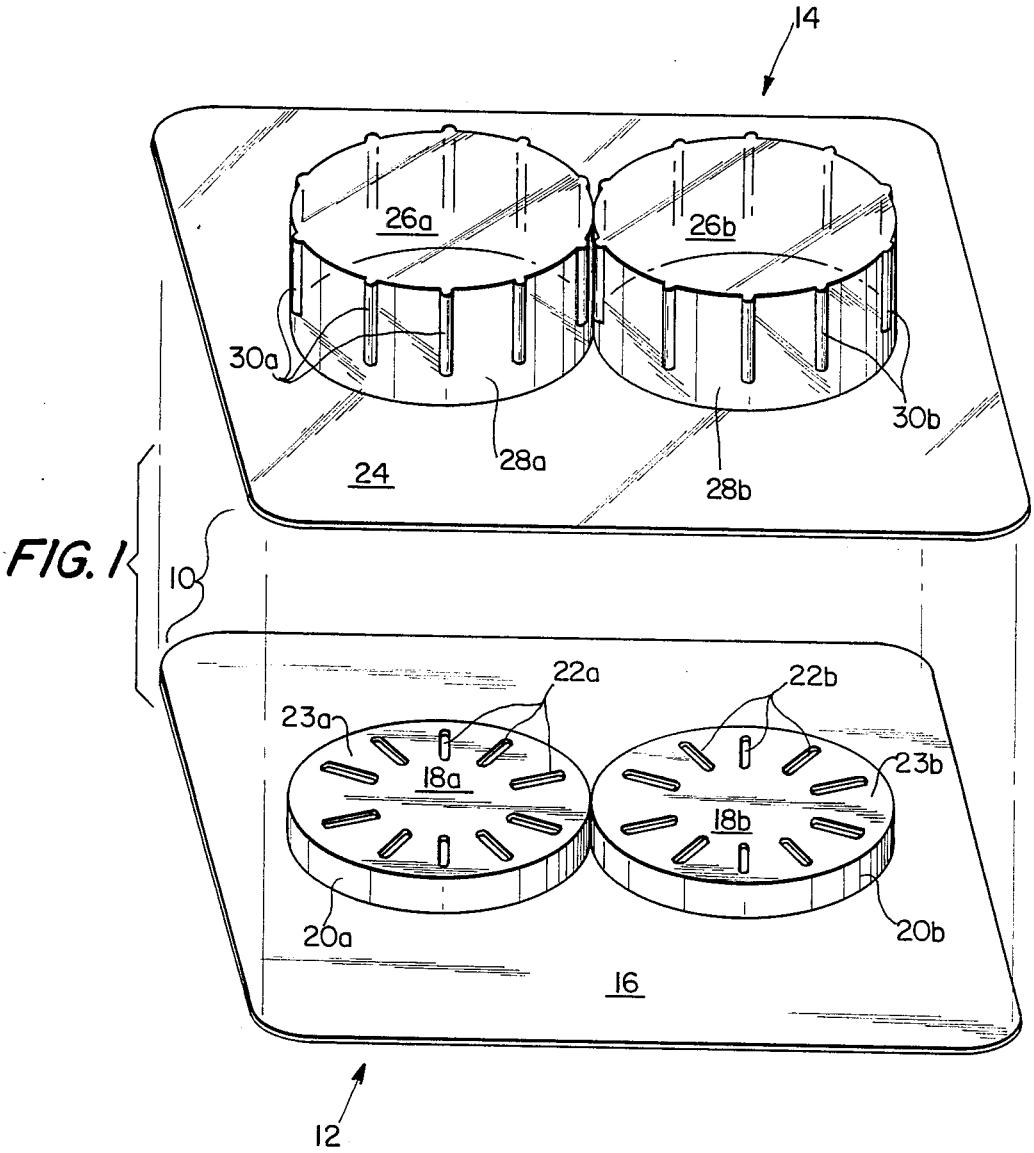
FIG. 1 is an exploded perspective view of a package according to the present invention.

With reference now to the drawings in which like numerals represent like elements, one preferred embodiment of a package 10 is depicted in FIG. 1. Package 10 is an improved package of the type described above and shown in U.S. Pat. Nos. 3,685,717 (Seiferth et al) and 3,498,018 (Seiferth et al), which patents are herein incorporated by reference.

Generally, packages of the type disclosed in the above patents are formed in two parts, a cover and a base. The cover is thermoformed from a sheet of flexible or rigid plastic material so as to have one or more bubble-like or cup-like cavities formed therein. The cavities lie wholly within the margins of the remainder of the flat sheet or flange portion. The base of each package acts as a closure for the cavity in the cover. Preferably, the base includes a thermoformed plug-like embossment or pedestal which fits like a stopper or plug into the open end of the bubble of cavity. The balance of the base or flange is then available for flat surface-to-surface sealing engagement with the flange or flat portion of the cover in which the bubbles or cavities are formed.

In order to form the package, it is generally desired to vacuumize and hermetically seal the package in order to preserve the perishable food contents in excellent condition with prolonged shelf life. Various plastics may be used that lend themselves to thermoforming techniques and which are formulated so as to provide adequate resistance to transmission of air, oxygen, and moisture. Since it will usually be necessary or desirable to refrigerate, or even freeze, many packaged items, the plastic materials used should have adequate impact strength at low temperatures. A variety of suitable plastic materials are disclosed in the above-identified references.

Conveniently, a seal forming adhesive material is interposed between the flanges of the cover and base about the entire periphery adjacent the bottom edges of the sidewalls of the base and cover. The adhesive substance is of a character which provides a hermetic seal when the package is closed under a vacuum. A number of suitable adhesives are available and are mentioned in the above-identified patents. A peelable seal can be formed using a suitable adhesive or can occur by heat sealing multilayered plastics. Alternatively, a seal can be used such that it will be necessary to destroy the package in order to gain access to the contents. In the latter case, a heat seal can be used.

In forming a package according to the prior art methods described in the above-mentioned patents, the product is generally of a somewhat compressible or formable nature. Initially, the compressible product is arranged in the form of a mass in the cavity of the cover. The pedestal of the base is then telescoped within the sidewall of the cavity of the cover with the pedestal of the base and top wall of the cover being parallel to one another. The product completely fills the space between the top wall and pedestal so as to enhance the appearance of the package and eliminate localized stresses in the package material. Preferably, the product is compressed between the pedestal of the base and the top wall of the cover by application of pressure to the outside of these surfaces.

As shown in FIG. 1, package 10 of the present invention includes a base 12 and a cover 14 which are generally horizontally oriented in use. Base 12 and cover 14 are typically made of a plastic material with base 12 being opaque and cover 14 being transparent. Base 12 includes a marginal base flange 16 from which two raised pedestals 18*a* and 18*b* are provided. Pedestals 18*a* and 18*b* are supported above marginal base flange 16 by respective short peripheral sidewalls 20*a* and 20*b*. In this embodiment, pedestals 18*a* and 18*b* are circularly shaped and are provided with a plurality of depressions or grooves 22*a* and 22*b*, respectively, in the upper surface 23*a* or 23*b* of pedestals 18*a* and 18*b*. As shown, grooves 22*a* and 22*b* have one outer end adjacent respective sidewalls 20*a* and 20*b*, and are directed substantially radially towards the center of respective pedestal 18*a* and 18*b*. It should be noted that grooves 22*a* and 22*b* do not extend all the way to respective sidewalls 20*a* and 20*b* in this embodiment. In addition, it should also be noted that grooves 22*a* and 22*b* preferably have a rounded cross section.

In the embodiment of the present invention disclosed in FIG. 1, base 12 has an overall size of approximately 10.4 centimeters by 20.5 centimeters. With a base 12 of this size, pedestals 18*a* and 18*b* have a diameter of approximately 7.5 centimeters with upper surfaces 23*a* and 23*b* located at a height of approximately 0.6 centimeters above marginal base flange 16. Pedestals 18*a* and 18*b* are preferably centered laterally in marginal base flange 16 and offset somewhat to one side longitudinally to accommodate a label, hanger hole, or the like. Grooves 22*a* and 22*b* have a width of 0.15 centimeters to 0.3 centimeters, a depth of 0.15 centimeters to 0.3 centimeters, and a length of approximately 1.4 centimeters. As shown, grooves 22*a* and 22*b* are spaced from respective sidewalls 20*a* and 20*b* by 0.2 to 0.4 cm. Where ten grooves 22*a* and 22*b* are provided in respective pedestals 18*a* and 18*b*, grooves 22*a* and 22*b* are radially directed and spaced every 36°.

Cover 14 includes a marginal cover flange 24 which is approximately the same overall size as marginal base flange 16. Cover 14 also includes circular top walls 26*a* and 26*b* which are spaced from flat cover sheet 24 by long peripheral sidewalls 28*a* and 28*b*, respectively. Circular top walls 26*a* and 26*b* are located above marginal cover flange 24 so as to overlie circular pedestals 18*a* and 18*b*. In addition, long peripheral sidewalls 28*a* and 28*b* are sized so as to telescopically and snugly recieve short peripheral sidewalls 20*a* and 20*b* of base 12.

As with the prior packages mentioned above, long peripheral sidewalls 28*a* and 28*b* are provided with concave channels 30 along the interior surface which channels extend to top walls 26*a* and 26*b*. However, instead of extending all of the way to marginal cover flange 24 as in the earlier packages, concave channels 30 terminate at a height above flat cover sheet 24. The height at which concave channels 30 terminate is equal to or greater than the height of short peripheral sidewalls 20*a* and 20*b* of base 12. Preferably, there is thus a space between the ends of concave channels 30 and short peripheral sidewalls 20*a* and 20*b* of 0 to 0.6 cm.

In the embodiment of the invention depicted in FIG. 1, top walls 26*a* and 26*b* of cover 14 have a diameter of approximately 7.2 centimeters. As the openings in marginal cover flange 25 beneath top walls 26*a* and 26*b* are the same size as pedestals 18*a* and 18*b*, that is 7.5 centimeters in diameter, peripheral sidewalls 28*a* and 28*b* are preferably tapered slightly or are slightly frusto-conical in shape to accommodate the insertion of pedestals 18*a* and 18*b*. The height of long peripheral sidewalls 28*a* and 28*b* is approximately 3.5 centimeteres in this embodiment.

Concave channels 30*a* and 30*b* in long peripheral sidewalls 28*a* and 28*b*, respectively, have a width of approximately 0.2 to 0.4 centimeters, and a depth of approximately 0.03 to 0.1 centimeters. Concave channels 30*a* and 30*b* extend from top walls 26*a* and 26*b*, respectively, for approximatley 2.6 centimeters. Thus, as pedestals 18*a* and 18*b* have a height of approximately 0.6 centimeters, concave channels 30*a* and 30*b* terminate approximately 0 to 0.3 centimeters above corresponding pedestals 18*a* and 18*b* when package 10 is formed.

Where there are ten grooves 22*a* and 22*b* in pedestals 18*a* and 18*b*, respectively, preferably there are also ten concave channels 30*a* and 30*b* in respective long peripheral sidewalls 28*a* and 28*b*. Concave channels 30*a* and 30*b* are equidistantly spaced, and are therefore located at 36° increments around respective top walls 26*a* and 26*b*.

In use, package 10 functions in the following manner. Initially, base 12 and cover 14 are constructed as described above. Next, cover 14 is provided with a stack of a sliced product inserted into the cavity of cover 14. Base 12 is then located on top of base 12 such that top walls 26*a* and 26*b* engage the top of the respective product and long peripheral sidewalls 28*a* and 28*b* surround the respective product. Top walls 26*a* and 26*b* and pedestals 18*a* and 18*b* are then pressed toward one another while a vacuum is drawn in the space between top walls 26*a* and 26*b* and pedestals 18*a* and 18*b*. As this occurs, concave channels 30*a* and 30*b* assist in this evacuation. During evacuation, any free liquids from the meat products or the like migrate to grooves 22*a* and 22*b* or concave channels 30*a* and 30*b*. After final forming, the seal forming adhesive located between marginal base flange 16 and marginal cover flange 24 results in package 10 being air tight.

It should be appreciated that the termination of concave channels 30 at a height above marginal cover flange 24 which is greater than the height of short peripheral sidewalls 20*a* and 20*b* prevents the unsightly appearance of stripes or non-transparent free liquids along short peripheral sidewalls 20*a* and 20*b*. As mentioned above, this unsightly stripe effect may occur in earlier packages where the concave channels extend all of the way to marginal cover flange 24. It should also be appreciated that free liquids from the meat product migrate to grooves 22*a* and 22*b* thus reducing or eliminating liquid drawn by the evacuation between short peripheral sidewalls 20*a* and 20*b* and long peripheral sidewalls 28*a* and 28*b*, respectively. In addition, the migration of free liquids between marginal base flange 16 and marginal cover flange 24 is reduced.

It should be further appreciated that the collective volume of grooves 22*a* and 22*b* may be matched to the amount of normal free liquid (juices) which are expected in the meat product or the like to be packaged. If too little collective volume is provided, free liquids may collect around short peripheral sidewalls 20*a* and 20*b* and present an unsightly appearance.

Figure 2:
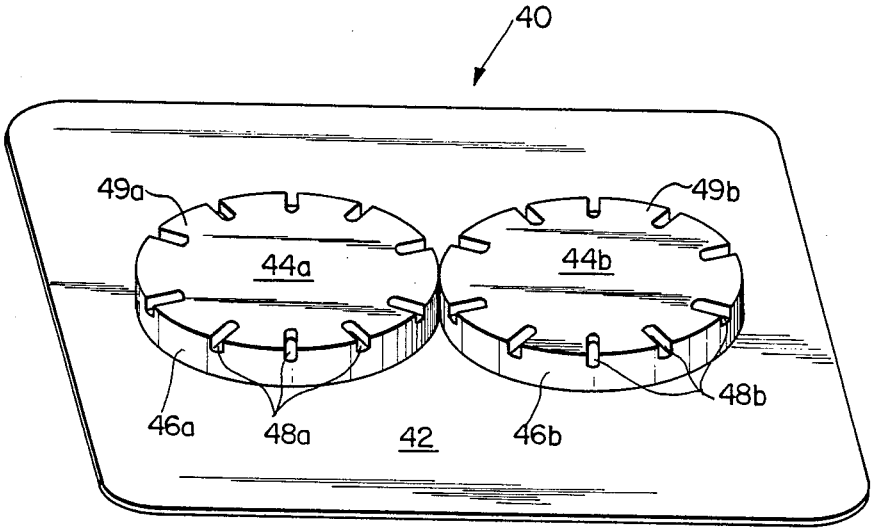
FIG. 2 is a perspective view of an alternative embodiment of a base for use with the cover depicted in FIG. 1.

Depicted in FIG. 2 is an alternative embodiment of a base 40 which can be used in place of base 12 with cover 14 which is depicted in FIG. 1. Similar to base 12, base 40 includes a marginal base flange 42, pedestals 44*a* and 44*b*, and short peripheral sidewalls 46*a* and 46*b* in the upper surfaces 49*a* and 49*b* of pedestals 44*a* and 44*b*, respectively.

It should be appreciated that grooves 48*a* and 48*b* are similar to grooves 22*a* and 22*b* described above. However, grooves 48*a* and 48*b* extend all the way to short peripheral sidewalls 46*a* and 46*b*, respectively, as shown. As with grooves 22*a* and 22*b*, grooves 48*a* and 48*b* are equidistantly spaced around short peripheral sidewalls 46*a* and 46*b*, respectively. In addition, the ends of grooves 48*a* and 48*b* adjacent respective short peripheral sidewalls 46*a* and 46*b* are in a mating position adjacent a coresponding lower end of a respective concave channel in the cover.

In use, base 40 functions in the same manner as base 12 in conjunction with cover 14. Thus, free liquids from the meat product or the like collect in grooves 48*a* and 48*b* as the package is assembled. It should be noted that the free liquids may be visible in the ends of grooves 48*a* and 48*b* which extend to short peripheral sidewalls 46*a* and 46*b* and thus present an opening slightly below upper surfaces 49*a* and 49*b* of pedestals 44*a* and 44*b*, respectively. However, the small amount of free liquids visible in these ends will be quite small.

Figure 3:
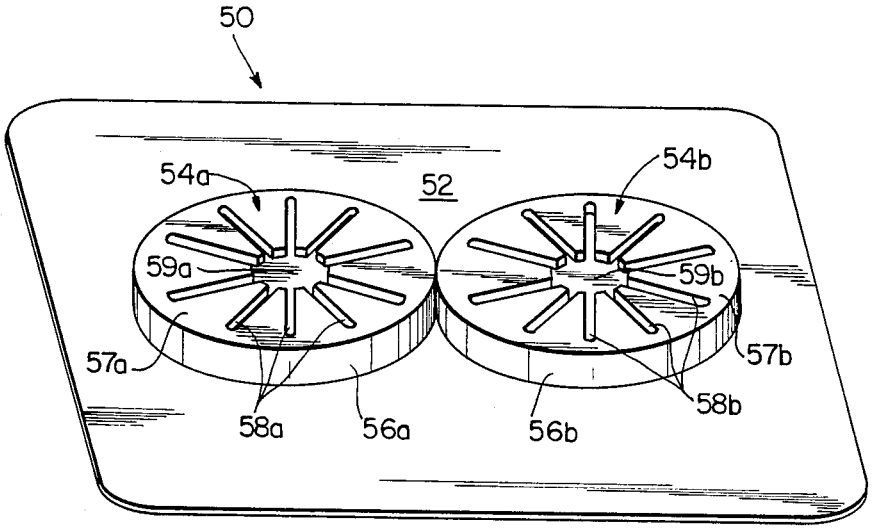
FIG. 3 is a perspective view of another alternative embodiment of a base for use with the cover depicted in FIG. 1.

Depicted in FIG. 3 is still another embodiment of a base 50 which can be used in place of base 12 with cover 14. Similar to base 12, base 50 includes a marginal base flange 52, pedestals 54*a* and 54*b*, and short peripheral sidewalls 56*a* and 56*b*. Provided in the upper surfaces 57*a* and 57*b* of pedestals 54*a* and 54*b* are grooves 58*a* and 58*b*, respectively. As with grooves 22*a* and 22*b* in base 12, grooves 58*a* and 58*b* terminate with one end adjacent to short peripheral sidewalls 56*a* and 56*b*, respectively. Grooves 58*a* and 58*b* are directed radially toward the center of respective pedestals 54*a* and 54*b*, where central cavities 59*a* and 59*b*, respectively, are provided. As shown, grooves 58*a* and 58*b* terminate in respective cavities 59*a* and 59*b*.

In use, base 50 is used in the same manner as base 40 and base 12 described above. However, by use of cavities 59*a* and 59*b*, an increased amount of free liquids is collectable in cavitites 59*a* and 59*b* and grooves 58*a* and 58*b*. Base 50 is thus advantageously used where a large relative amount of free liquids is present in the meat product or the like to be packaged.

Depicted in FIG. 4 is an alternative embodiment of a package 60. Package 60 is used for relatively rectangular sliced meat products or the like which are contained in a single stack. Package 60 includes a base 62 and cover 64. Base 62 includes a marginal base flange 66, a pedestal 68, and a short peripheral sidewall 70 connecting pedestal 68 to marginal base flange 66. Provided in an upper surface 71 of pedestal 68 is a plurality of grooves 72. As shown, grooves 72 are equidistantly spaced along the straight portions of short peripheral sidewall 70 and are directed perpendicularly to a respective straight portion of short peripheral sidewall 70. Grooves 72 terminate prior to an adjacent straight portion of short peripheral sidewall 70 and extend for a short distance toward the center of pedestal 68.

Cover 64 is similar to cover 14 and includes a marginal cover flange 74, a top wall 76, and a long peripheral sidewall 78 connecting top wall 76 to marginal cover flange 74. Concave channels 80 are provided in long peripheral sidewall 78 as shown. Concave channels 80 are equidistantly spaced along respective straight portions of long peripheral sidewall 78 and extend vertically from top wall 76. Concave channels 80 terminate above marginal cover flange 74 at a height which is greater than or equal to the height of short peripheral sidewall 70 of base 62. As with package 10, the spacing and number of channels 80 along long peripheral sidewall 78 correspond to the spacing and number of grooves 72 provided along short peripheral sidewall 70.

Package 60 is assembled in substantially the same manner as package 10 described above. Thus, a rectangular meat product or the like is locate on pedestal 68 as base 62 is hermetically sealed to cover 64. As shown, the spacing and number of grooves 72 in short peripheral sidewall 70 corresponds to the spacing and number of concave channels 80 in long peripheral sidewall 78. Thus, the ends of grooves 72 adjacent respective short peripheral sidewall 70 are also adjacent the lower ends of respective concave channels 80 in respective long peripheral sidewall 78. As base 62 is being hermetically sealed to cover 64, the evacuation of package 60 is facilitated by concave channels 80. In addition, free liquids from the meat product or free liquids containing particulate matter (e.g. pepper) or the like are collected in grooves 72 and migration of liquid between short sidewall 70 and long peripheral sidewall 78 is reduced or eliminated.

Depicted in FIG. 5 is an alternative embodiment of a base 82 which can be used in place of base 62 in package 60. Base 82 includes a marginal base flange 84, a rectanglular pedestal 86, and a short peripheral sidewall 88 connecting pedestal 86 to marginal base flange 84. The upper surface 89 of pedestal 86 is provided with short grooves 90 and long grooves 92 as shown. Short grooves 90 are located adjacent the corners of pedestal 86 and project substantially perpendicularly to the adjacent straight portions of short peripheral sidewall 88. Long grooves 92 are located between respective short grooves 90 along a respective straight portion of short peripheral sidewall 88. Long grooves 92 are oriented substantially perpendicularly to a respective straight portion of short peripheral sidewall 88 and extend inwardly of pedestal 86.

Base 82 is used in the same manner as base 62 with package 60. However, it should be appreciated that long grooves 92 allow for a greater collection of free liquids from the meat product or the like. In addition, long grooves 92 provide some additional reinforcement for pedestal 86.

It should be appreciated that although bases 12, 40 and 50 which are used with cover 12 are used for double stacks of product, packages of this type could be used having only a single pedestal and top wall for a single stack of product. Similarly, packages of the type using cover 64 and bases 62 and 82 could be designed to hold two or more stacks of product.

While the present invention has been described with respect to several embodiments thereof, it will be understood by those of ordinary skill in the art that variations and modifications can be effected within the scope and spirit of the invention.

We claim:

1. In a container for sliced meat products or the like comprising: (a) a base which is horizontal in use including a marginal base flange, a raised pedestal having a flat support surface upon which the product rests, and a short peripheral sidewall extending vertically from said marginal base flange to said pedestal around the periphery of said pedestal; and (b) a cover which is horizontal in use including a marginal cover flange shaped complementary to said marginal base flange, a raised top wall under which the product is located, and a long peripheral sidewall extending vertically from said marginal base flange to said top wall around the periphery of said top wall and provided with concave channels along the interior surface extending vertically from said marginal cover flange to said top wall; said short peripheral sidewall of said base being snugly received inside said long peripheral sidewall of said cover with said marginal base flange sealingly attached to said marginal cover flange, a space being provided between said pedestal and said top wall in which the product is located; the improvement wherein:

said concave channels terminate at a height above said marginal cover flange which is equal to or greater than the height of said short peripheral sidewall of said base such that after said short peripheral sidewall of said base is received inside said long peripheral sidewall of said cover, said concave channels terminate at or above said short peripheral sidewall; and a plurality of depressions are provided in the flat support surface of said pedestal in which free liquids from the product are collected wherein said depressions are grooves which extend longitudinally away from an adjacent portion of said short peripheral sidewall said flat support surface being spaced above said marginal cover flange.

2. A container as claimed in claim 1 wherein said grooves have a rounded cross section.

3. A container as claimed in claim 1 wherein said grooves extend to said short peripheral sidewall.

4. A container as claimed in claim 1 wherein said grooves terminate just prior to said short peripheral sidewall.

5. A container as claimed in claim 4 wherein said grooves extend substantially perpendicularly to said adjacent portion of said short peripheral sidewall.

6. A container as claimed in claim 1 wherein said grooves are equidistantly spaced from one another along said short peripheral sidewall.

7. A container as claimed in claim 1 wherein the end of each said groove adjacent said portion of said short peripheral sidewall is matingly positioned adjacent a corresponding lower end of a respective said concave channel.

8. A container as claimed in claim 7 wherein said grooves are equidistantly spaced from one another along said short peripheral sidewall.

9. A container as claimed in claim 1 and further including a central cavity in said pedestal, and wherein a plurality of said grooves open into said cavity.

10. A container as claimed in claim 1 wherein said pedestal is circularly shaped and said grooves are radially directed.

11. A container as claimed in claim 1 wherein said pedestal is rectangularly shaped.

12. A container as claimed in claim 11 wherein there is a corner groove adjacent each corner of said pedestal along each said side, wherein there are intermediate grooves between said corner grooves of each side, and wherein said corner grooves of said pedestal are shorter than said intermediate grooves.

13. A container as claimed in claim 1 wherein the distance between the height at which said concave channels terminate and the height of said short peripheral sidewall is from 0 to 0.6 cm.

* * * * *